US010663170B2

(12) United States Patent
Abu-Irshaid et al.

(10) Patent No.: US 10,663,170 B2
(45) Date of Patent: May 26, 2020

(54) FLOW CONDITIONER TO REDUCE COMBUSTION DYNAMICS IN A COMBUSTION SYSTEM

(71) Applicant: DOOSAN HEAVY INDUSTRIES & CONSTRUCTION CO., LTD., Gyeongsangnam-do (KR)

(72) Inventors: Esam Abu-Irshaid, Lake Worth, FL (US); Kevin Spence, Jupiter, FL (US)

(73) Assignee: Doosan Heavy Industries Construction Co., Ltd., Gyeongsangnam-do (KR)

( * ) Notice: Subject to any disclaimer, the term of this patent is extended or adjusted under 35 U.S.C. 154(b) by 299 days.

(21) Appl. No.: 15/410,109

(22) Filed: Jan. 19, 2017

(65) Prior Publication Data

US 2018/0202661 A1 Jul. 19, 2018

(51) Int. Cl.

| | |
|---|---|
| ***F23R 3/10*** | (2006.01) |
| ***F23R 3/16*** | (2006.01) |
| ***F23R 3/00*** | (2006.01) |

(52) U.S. Cl.

CPC ..... *F23R 3/10* (2013.01); *F23R 3/002* (2013.01); *F23R 3/16* (2013.01); *F05D 2260/963* (2013.01); *F05D 2260/964* (2013.01); *F23R 2900/00014* (2013.01)

(58) Field of Classification Search

CPC ..... F23R 3/10; F23R 3/16; F23R 3/04; F23R 2900/00014; F23R 3/002; F23R 3/02; F23R 3/06; F23R 3/26; F23R 3/286; F23R 3/60; F05D 2260/96; F05D 2260/963; F05D 2260/964; F05D 2270/14; F05D 2270/90

See application file for complete search history.

(56) References Cited

U.S. PATENT DOCUMENTS

| | | | | |
|---|---|---|---|---|
| 6,920,758 | B2 * | 7/2005 | Matsuyama | F23R 3/286 431/114 |
| 9,625,158 | B2 * | 4/2017 | Olsen | F23R 3/286 |
| 9,709,279 | B2 * | 7/2017 | Crothers | F23R 3/04 |
| 2013/0042627 | A1 * | 2/2013 | Gerendas | F23R 3/10 60/782 |

(Continued)

FOREIGN PATENT DOCUMENTS

| | | |
|---|---|---|
| JP | 2008-064405 A | 3/2008 |
| JP | 2015-161500 A | 9/2015 |

OTHER PUBLICATIONS

Roger Lloyd, Optimum Placement of Helmholtz Resonators for Damping Pressure Oscillations, 1968, Princeton University, Thesis L77, Dudley Knox Library of Naval Postgraduate School, Monterey, CA 93943-5101, retrieved from https://core.ac.uk/download/pdf/36706119.pdf on Dec. 13, 2018 (Year: 1968).*

(Continued)

*Primary Examiner* — Jason H Duger
*Assistant Examiner* — Stephanie Cheng
(74) *Attorney, Agent, or Firm* — Invenstone Patent, LLC

(57) ABSTRACT

A flow conditioner in a combustor of a gas turbine comprises a body and a flow conditioning portion configured to be placed in an air path providing air flow to a combustion chamber, the flow conditioning portion including a plurality of holes tuned to a damping frequency to dampen a pressure fluctuation caused by combustion dynamics from the combustion chamber.

14 Claims, 7 Drawing Sheets

(56) References Cited

U.S. PATENT DOCUMENTS

| | | | | |
|---|---|---|---|---|
| 2015/0159878 | A1* | 6/2015 | Schildmacher | F23R 3/58 60/776 |
| 2016/0076766 | A1* | 3/2016 | Jayatunga | F23K 5/005 60/779 |
| 2017/0198912 | A1 | 7/2017 | Thackway et al. | |

OTHER PUBLICATIONS

A Korean Office Action dated Jun. 5, 2019 in connection with Korean Patent Application No. 10-2018-0008929.

* cited by examiner

FLOW CONDITIONER TO REDUCE COMBUSTION DYNAMICS IN A COMBUSTION SYSTEM

CROSS-REFERENCE TO RELATED APPLICATIONS

This application is related to co-pending U.S. patent application Ser. No. 15/419,764, entitled "DEVICE TO CORRECT FLOW NON-UNIFORMITY WITHIN A COMBUSTION SYSTEM," and co-pending U.S. patent application Ser. No. 15/414,063, entitled "RESONATOR FOR DAMPING ACOUSTIC FREQUENCIES IN THE COMBUSTION SYSTEM BY OPTIMIZING IMPINGEMENT HOLES AND SHELL VOLUME," which are incorporated herein by reference.

BACKGROUND

Combustors, such as those used in industrial gas turbines, for example, mix compressed air with fuel and expel high temperature, high pressure gas downstream. The energy stored in the gas is then converted to work as the high temperature, high pressure gas expands in a turbine, for example, thereby turning a shaft to drive attached devices, such as an electric generator to generate electricity.

As the air/fuel mixture combusts, the hot gas that is generated creates fluctuations in pressure. These pressure fluctuations at certain frequencies (e.g., 1-1000 Hz) create acoustic pressures through the system. Acoustic pressure fluctuations in the combustion system can cause serious damage to the hardware if they excite the natural frequency of a component. Exciting the natural frequency of a component causes oscillation of that component in the system, thereby weakening, if not, destabilizing the structural integrity of the system.

There are known ways of preventing the excitation of natural frequency within the system. Acoustic pressure fluctuations that can generate natural frequencies may be reduced by redesigning the hardware, changing air splits, or adding resonators to the system. However, in large applications such as an industrial gas turbine, for example, this can result in adding significant cost or reduction of the combustion system performance as extensive time for tests and modifications are needed. Additionally, external resonators for this purpose can reduce the combustor performance as the resonator will need air for damping. The air will be taken away from combustion, thereby decreasing the efficiency of the combustion. Such may result in increased emission levels, metal temperature, and thermal stresses, all of which will affect the life and performance of the structure of the system.

BRIEF SUMMARY

In one embodiment of the invention, a combustor of a gas turbine comprises one or more fuel nozzles arranged in a headend of the combustor, a combustion chamber in which mixture of air and fuel is combusted, an air path providing air flow to the combustion chamber, and a flow conditioner placed in the air path to dampen a pressure fluctuation caused by combustion dynamics from the combustion chamber.

In another embodiment of the invention, a flow conditioner in a combustor of a gas turbine comprises a body and a flow conditioning portion configured to be placed in an air path providing air flow to a combustion chamber, the flow conditioning portion including a plurality of holes tuned to a damping frequency to dampen a pressure fluctuation caused by combustion dynamics from the combustion chamber.

DETAILED DESCRIPTION

Various exemplary embodiments of a flow conditioner that regulates combustion dynamics are described. It is to be understood, however, that the following explanation is merely exemplary in describing the devices and methods of the present disclosure. Accordingly, any number of reasonable and foreseeable modifications, changes, and/or substitutions are contemplated without departing from the spirit and scope of the present disclosure.

Figure 1:
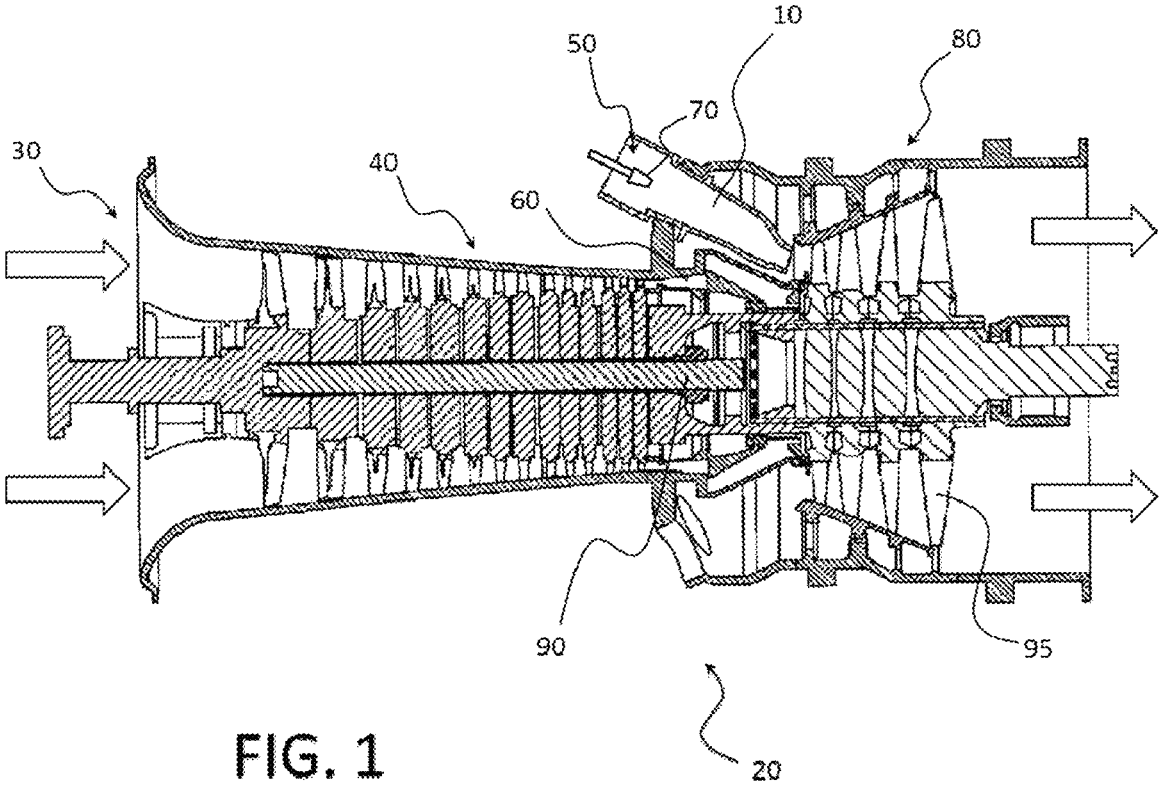
FIG. 1 shows a combustion system in an exemplary gas turbine, according to an example embodiment.

FIG. 1 shows combustor 10 according to an exemplary embodiment. For purposes of explanation only, the combustor 10 is shown in FIG. 1 as applied to an industrial gas turbine 20. However, combustors of other applications may be applied without departing from the scope of the present invention. For purposes of explanation and consistency, like reference numbers are directed to like components in the figures.

As shown in FIG. 1, air to be supplied to the combustor 10 is received through air intake section 30 of the gas turbine 20 and is compressed in compression section 40. The compressed air is then supplied to headend 50 through air path 60. The air is mixed with fuel and combusted at the tip of nozzles 70 and the resulting high temperature, high pressure gas is supplied downstream. In the exemplary embodiment shown in FIG. 1, the resulting gas is supplied to turbine section 80 where the energy of the gas is converted to work by turning shaft 90 connected to turbine blades 95.

As can be seen in FIG. 1, the entire structure is connected to the combustor 10 and therefore the acoustic pressure fluctuations caused by the combustion dynamics of the hot gas generated by the combustion resonates through the entire system. Therefore, controlling the generation of the acoustic pressure fluctuation at the source (e.g., combustor) will have a lasting effect on the operation, performance, and longevity of the entire system.

Figure 2:
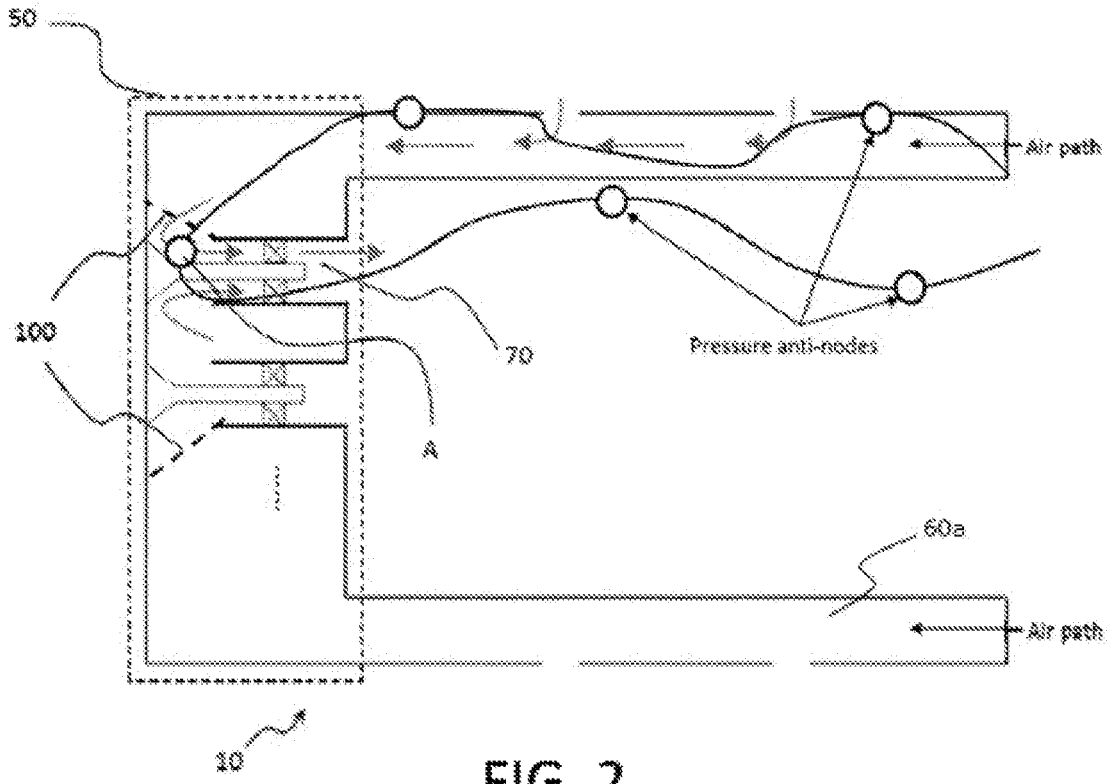
FIG. 2 shows a sectional view of a combustor, according to an example embodiment.

FIG. 2 is a sectional view of an exemplary embodiment of combustor 10. As shown in FIG. 2, compressed air is supplied to the headend 50 through a headend air path 60*a* of the air path 60. The air is mixed with fuel and combusted at the nozzles 70. In accordance with an exemplary embodiment, a flow conditioner, such as screen 100, is provided at the headend 50 to dampen the acoustic pressure fluctuations generated in the combustor 10.

Figure 3:
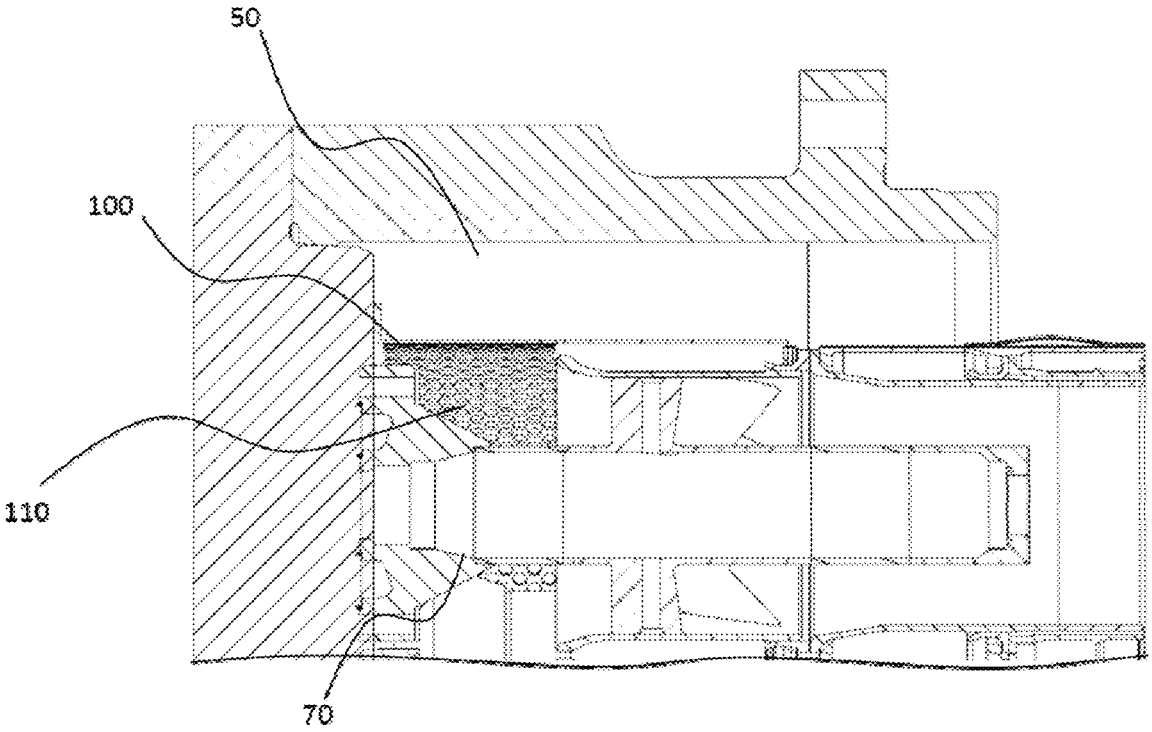
FIG. 3 shows a sectional view of a headend area of a combustor, according to an example embodiment.

FIG. 3 is a sectional view of an exemplary embodiment of headend 50. As shown in FIG. 3, the screen 100 is placed at the inlet location of the headend 50. However, as further explained below, the location of the screen 100 may vary depending on the location of the target wave within the combustor 10. The screen 100 reduces the pressure fluctuation passing through screen holes 110 due to the friction between the acoustic flow and the screen holes 110. Preferably, frequencies between 1-500 Hz and high range frequencies less than 1,000 Hz are dampened utilizing existing hardware in the combustor, thereby avoiding the use of external resonators to control costs while maintaining efficiency of the combustion. Pressure drop with as little as 0.5% to 1% across the screen 100 provide damping adequate enough to suppress acoustic pressure fluctuations that can damage the system. The higher pressure drops result in higher damping.

Figure 4:
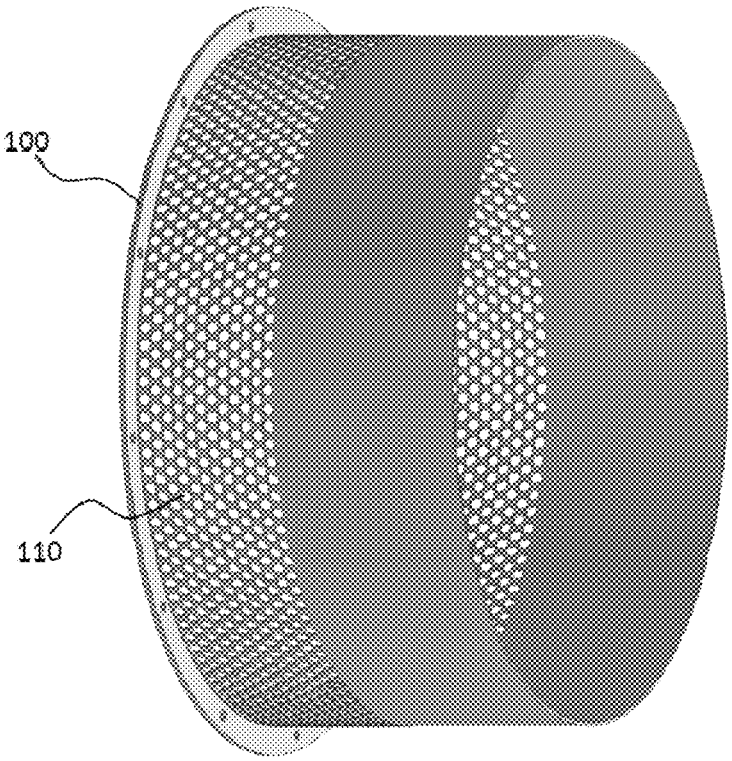
FIG. 4 shows a perspective view of a flow conditioner, according to an example embodiment.

The effectiveness of the flow conditioner, in accordance with the exemplary embodiments, depends on the pressure drop across the screen 100 and the location of the targeted wave. Accordingly, exemplary embodiments include a flow conditioner such as screen 100 having various size, shape, and thickness of the screen holes 110. For example, FIG. 4 shows an exemplary flow conditioner such as screen 100 including body 105 having cylindrical screen holes 110.

Further, another exemplary embodiment includes a flow conditioner such as screen 100 located at one or more positions of anti-nodes along the air path within the combustor 10. For example, FIG. 2 shows screen 100 positioned near antinode A.

Low, intermediate, and high range frequencies can be damped by utilizing screen 100 in accordance with the present invention. Low and intermediate frequencies, such as from longitudinal waves having long wave lengths, are damped in relation to how close the pressure anti-node is to the screen 100. High range frequencies, such as from tangential or radial waves having shorter wave lengths, can also receive damping through the screen 100.

Longitudinal waves are waves that occupy the combustor 10 in the axial directions. The critical dimension is the length of the combustor, air path and/or hot path in the axial direction. These waves have generally long wave lengths, in the same order as the combustor length and thus low frequency magnitude range. In general, frequency magnitude for the longitudinal waves in combustion system for industrial gas turbine typically ranges between about 10 Hz to 800 Hz.

Tangential and radial waves, which sometime are referred to as transverse waves, have much shorter wave length and thus higher frequency magnitude. These waves occupy the circumference of a combustor in the hot gas path, which has much shorter length compared to the axial direction of the combustor. In general, the frequency magnitude is typically between about 1,000 Hz to about 7,000 Hz depending on the mode shape. The critical dimension of the tangential form is the circumference of the combustor. The tangential form can be (1T, 2T, etc.). The higher the tangential form, the higher the frequency and thus the wave will have more nodes and anti-nodes. Radial waves can be coupled with tangential waves or appear as separate. The critical dimension is the diameter of the combustor. The radial form can be as (1R, 2R, etc.). The higher the radial form, the higher the frequency magnitude and thus more nodes and anti-nodes.

In one example, the exemplary embodiments obtain damping by having the screen holes 110 close to the location of an anti-node where the pressure is maximum. Moving away from anti-node reduces the damping capability of the flow conditioner, and placing the flow conditioner above a node was found to have little or no damping capability as the node signify zero-pressure. As the node and anti-node location is part of the mode shape of a combustor, the node and anti-node locations can be precisely located once the mode shape is identified. Two exemplary methods are described in identifying the mode shape: (1) Acoustic Modeling—acoustic tool may be used to predict unstable frequencies and thus their mode shapes, and (2) Acoustic Measurements—high sampling pressure sensors distributed axially and/or circumferentially, depending on the targeted mode, may be used to directly measure the frequencies at target locations. The sampling rate of the sensor depends on the frequencies to be measured and the measured pressure data are post-processed to produce phase and amplitude. The phase relation associated with the amplitude ratio can be used to identify the mode shape and thus the location of the node and anti-node. FIG. 2 shows various antinode locations where screen 100 may be placed to diminish the acoustic pressure fluctuations.

In another example, the exemplary embodiments obtain damping by having the screen holes 110 and the backed volume (e.g., volume upstream of screen holes 110) tuned to match the targeted frequency. In effect, the system volume in conjunction with the screen holes represent a Helmholtz resonator. If the flow conditioner with the backed volume frequency is different from the targeted frequency, damping is diminished and in worst case, have no effect, even if the flow conditioner is directly placed over an anti-node. In accordance with the exemplary embodiments, the size, shape, thickness, and air flow through the screen 100 (e.g., the number of holes, density of the holes, etc.) affect both damping and resonator frequency.

Figure 5A:
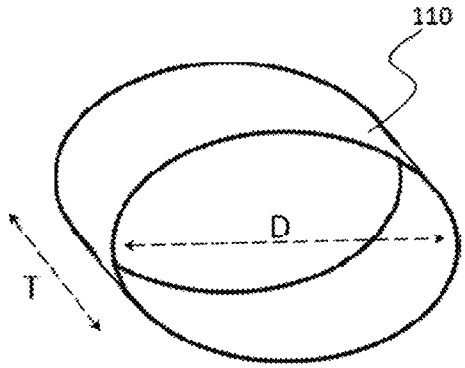
FIGS. 5A and 5B show exemplary screen holes of a flow conditioner, according to example embodiments.
Figure 5B:
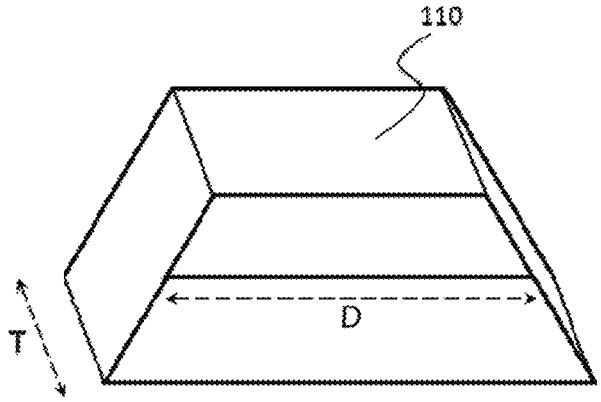
Figure 6A:
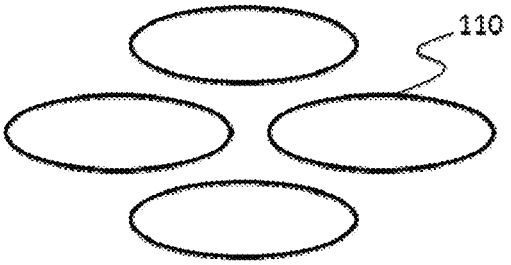
FIGS. 6A-6D show exemplary shapes of screen holes, according to example embodiments.
Figure 6B:
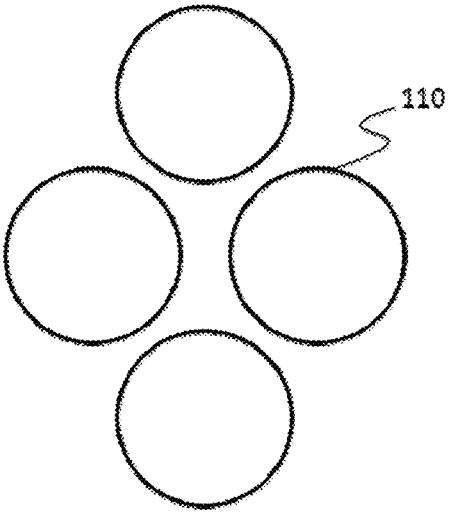
Figure 6C:
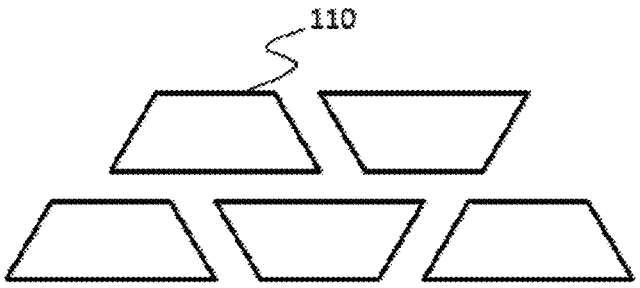
Figure 6D:
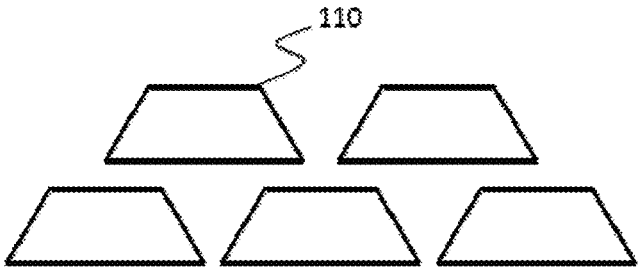

The hole diameter may be tuned to control the flow of gas and/or air. Higher frequencies require higher flow and flow widens the frequency range that is being damped. Accordingly, as shown in FIGS. 5A and 5B, the size of the hole (i.e., diameter D) affects the amount of flow thereby affecting the resonator frequency of the screen 100.

The thickness of the hole may also be tuned to control damping as hole thickness affects frequency magnitude. As the hole is made thicker, the damping is increased. Accordingly, as shown in FIGS. 5A and 5B, the thickness of the hole (i.e., thickness T) affects the resonator frequency of the screen 100.

Shape of the hole produces different frequencies and different damping characteristics. For example, there is a frequency shift from a cylindrical hole to a trapezoidal hole. Further, the frequency shifts up or down depending on the trapezoid angle as the change in the reactance is not linear. Similarly, smooth-edged holes produce different resonator frequency compared to sharp-edged holes for the same reasons as explained above. Accordingly, as shown in FIGS. 5A and 5B, the shape of the hole (e.g., cylindrical and trapezoidal, respectively) affects the resonator frequency of the screen 100. FIGS. 6A-6D shows exemplary embodiments of the arrangement of the various hole shapes. Other shapes and arrangements may be used without departing from the scope of the present invention. For example, In the exemplary embodiment shown in FIGS. 6A-6D, holes 110 are shown to be uniform in size and shape. However, the size and shape of holes 110 may be varied on flow controller 100 to fine tune the resonator frequency or the damping effect without departing from the scope of the present invention.

Some of the advantages of the exemplary embodiments include: reducing or eliminating the need to change the design of the hardware or system to minimize the effect of combustion dynamics as the screen 100 can easily be installed on the cover plate or other locations within the combustion system; no need to divert air to, or from, another source to create damping as no additional air is required since combustor air and headend air that is passing through the screen 100 is used to create the acoustic damping; targeting specific frequencies by adjusting the location of the screen, pressure drop, and hole thickness of the screen 100; and reducing or eliminating the combustion dynamics for wide range of frequencies from various types of waves (i.e., low, mid, and high frequencies generated by longitudinal, tangential, and radial waves) thereby extending the life of the hardware and system.

It will also be appreciated that the disclosure herein is not limited to combustion systems of industrial gas turbines. For example, combustion systems in aero gas turbines and gas turbines in general can also realize the advantages of the present disclosure. Further, the shapes, sizes, and thicknesses of the screen holes are not limited to those disclosed herein. For example, screen holes in the shape of a square, rectangle, triangle, and other polygonal structures, such as pentagon, hexagon, and octagon to name a few examples can also realize the advantages of the present disclosure.

The breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention (s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A combustor of a gas turbine, comprising:

one or more fuel nozzles arranged in a headend of the combustor;

a combustion chamber downstream of the headend in which a mixture of air and fuel is combusted;

an end cover disposed at an upstream end of the one or more nozzles and having an end cover surface that is perpendicular to the nozzle arrangement to face in a downstream direction;

an airpath providing an airflow to the combustion chamber; and a flow conditioner that is placed in the airpath and comprises:

a circumferential flange having a mounting surface mounted to the end cover surface of the end cover;

a corner, wherein the circumferential flange extends from a first side of the corner in parallel with the end cover surface; and a cylindrical body extending from a second side of the corner at a right angle relative to the end cover surface and having a circumferential screen in which a plurality of holes are formed in a circumferential surface of the cylindrical body;

wherein the flow conditioner and a backed volume of the combustor upstream of the plurality of holes form a Helmholtz resonator having a resonator frequency and the plurality of holes are tuned to match the resonator frequency to a targeted damping frequency to dampen a pressure fluctuation caused by combustion dynamics from the combustion chamber.

2. The combustor of claim 1, wherein the flow conditioner is disposed at an air inlet position in the headend.

3. The combustor of claim 1, wherein the flow conditioner is disposed at an anti-node location within the combustor.

4. The combustor of claim 1, wherein the plurality of holes are cylindrical.

5. The combustor of claim 1, wherein the plurality of holes are polygonal.

6. The combustor of claim 1, wherein the plurality of holes have shapes that vary around the circumference of the cylindrical body to fine tune the resonator frequency.

7. The combustor of claim 1, wherein the plurality of holes have sizes that vary around the circumference of the cylindrical body to fine tune the resonator frequency.

8. A flow conditioner placed in an airpath providing an airflow to a combustion chamber of a combustor of a gas turbine, the combustor including one or more fuel nozzles arranged in a headend of the combustor, the flow conditioner comprising:

a circumferential flange mounted to an end cover of the headend, the end cover being disposed at an upstream end of the one or more fuel nozzles and having an end cover surface that is perpendicular to the nozzle arrangement to face in a downstream direction;

a corner, wherein the circumferential flange extends from a first side of the corner in parallel with the end cover surface such that a mounting surface of the circumferential flange is mounted against the end cover surface; and a cylindrical body extending from a second side of the corner at a right angle relative to the end cover surface and having a circumferential screen in which a plurality of holes are formed in a circumferential surface of the cylindrical body;

wherein the flow conditioner and a backed volume of the combustor upstream of the plurality of holes form a Helmholtz resonator having a resonator frequency and the plurality of holes are tuned to match the resonator frequency to a targeted damping frequency to dampen a pressure fluctuation caused by combustion dynamics from the combustion chamber.

9. The flow conditioner of claim 8, wherein the flow conditioner is disposed at an air inlet position of a headend of the combustor.

10. The flow conditioner of claim 8, wherein the flow conditioner is disposed at an anti-node location within the combustor.

11. The flow conditioner of claim 8, wherein the plurality of holes are cylindrical.

12. The flow conditioner of claim 8, wherein the plurality of holes are polygonal.

13. The flow conditioner of claim 8, wherein the plurality of holes have shapes that vary around the circumference of the cylindrical body to fine tune the resonator frequency.

14. The flow conditioner of claim 8, wherein the plurality of holes have sizes that vary around the circumference of the cylindrical body to fine tune the resonator frequency.

* * * * *